US011443887B2

(12) United States Patent
Scholz

(10) Patent No.: US 11,443,887 B2
(45) Date of Patent: Sep. 13, 2022

(54) PLANAR TRANSFORMER HAVING INTEGRATED RING CORE

(71) Applicant: Phoenix Contact GmbH & Co. KG, Blomberg (DE)

(72) Inventor: Peter Scholz, Brakel (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 589 days.

(21) Appl. No.: 16/341,029

(22) PCT Filed: Oct. 4, 2017

(86) PCT No.: PCT/EP2017/075266
§ 371 (c)(1),
(2) Date: Apr. 10, 2019

(87) PCT Pub. No.: WO2018/069122
PCT Pub. Date: Apr. 19, 2018

(65) Prior Publication Data

US 2019/0237240 A1 Aug. 1, 2019

(30) Foreign Application Priority Data

Oct. 10, 2016 (DE) ..... 102016119164.7

(51) Int. Cl.
*H01F 19/00* (2006.01)
*H01F 27/28* (2006.01)
*H01F 19/08* (2006.01)

(52) U.S. Cl.
CPC ..... *H01F 27/2804* (2013.01); *H01F 19/08* (2013.01); *H01F 27/2895* (2013.01); *H01F 2019/085* (2013.01)

(58) Field of Classification Search
CPC .. H01F 27/2804; H01F 19/08; H01F 27/2895; H01F 2019/085; H01F 17/06; H01F 17/062; H01F 27/324
See application file for complete search history.

(56) References Cited

U.S. PATENT DOCUMENTS 3,238,484 A * 3/1966 Dacey ..... H01F 17/062 336/178
5,959,846 A * 9/1999 Noguchi ..... H01F 17/0033 361/782

(Continued)

FOREIGN PATENT DOCUMENTS

CN 105529156 A 4/2016
DE 4027994 A1 3/1992

(Continued)

OTHER PUBLICATIONS

Office Action issued in German patent application No. 102016119164.7, dated Jul. 24, 2017, 11 pp.

(Continued)

*Primary Examiner* — Mang Tin Bik Lian
(74) *Attorney, Agent, or Firm* — Kaplan Breyer Schwarz, LLP

(57) ABSTRACT

A planar, in particular intrinsically safe transformer, having: a sandwich-type layer structure having a plurality of layers extending horizontally and arranged vertically on top of one another, including a first and a second conductive layer and at least one insulating inner layer disposed between the two conductive layers, a plurality of electrical circuits, wherein a first electrical circuit and at least a second electrical circuit are galvanically isolated from each other; and at least one ring-type magnetic core having a hole, which acts at least on the first electrical circuit and the second electrical circuit. The core is arranged within the at least one insulating inner layer, a conductor of the first electrical circuit and a con- (Continued)

ductor of the second electrical circuit each have a winding with at least one winding turn, and the at least one winding turn of the first electrical circuit and the at least one winding turn of the second electrical circuit each run along the first conductive layer and along the second conductive layer and through the at least one insulating inner layer and through the hole of the core.

9 Claims, 14 Drawing Sheets

(56) References Cited

U.S. PATENT DOCUMENTS

| | | | | |
|---|---|---|---|---|
| 7,436,282 | B2 * | 10/2008 | Whittaker | H01F 17/0033 336/200 |
| 2004/0135662 | A1 * | 7/2004 | Harding | H01F 17/0006 336/229 |
| 2004/0212475 | A1 * | 10/2004 | Schumacher | H05K 1/165 336/200 |
| 2006/0109071 | A1 | 5/2006 | Thongsouk et al. | |
| 2011/0108317 | A1 * | 5/2011 | Harrison | H01F 17/0033 174/266 |
| 2014/0116758 | A1 * | 5/2014 | Li | H05K 1/165 174/255 |
| 2014/0266549 | A1 * | 9/2014 | Huang | H05K 3/4602 336/200 |
| 2015/0061817 | A1 * | 3/2015 | Lee | H01F 17/0033 336/221 |
| 2015/0101854 | A1 * | 4/2015 | Lee | H01F 41/046 29/606 |
| 2015/0194258 | A1 | 7/2015 | Scholz | |
| 2015/0349628 | A1 * | 12/2015 | Cheng | H01F 17/062 363/39 |
| 2016/0049235 | A1 * | 2/2016 | Parish | H01F 41/046 336/178 |
| 2016/0049236 | A1 * | 2/2016 | Kneller | H01F 27/2895 336/178 |
| 2016/0111196 | A1 | 4/2016 | Francis | |
| 2016/0111966 | A1 | 4/2016 | Wang et al. | |

FOREIGN PATENT DOCUMENTS

| | | | |
|---|---|---|---|
| DE | 19615921 | A1 | 10/1997 |
| DE | 10102367 | A1 | 8/2002 |
| DE | 102012003364 | A1 | 8/2013 |
| DE | 102012003365 | A1 | 8/2013 |
| DE | 102012016569 | A1 | 2/2014 |
| WO | 2015/190229 | A1 | 12/2015 |
| WO | 2016/111282 | A1 | 4/2016 |

OTHER PUBLICATIONS

International Search Report and Written Opinion issued in PCT application No. PCT/EP2017/075266, dated Dec. 20, 2017, 10 pp.
English Translation of International Preliminary Report on Patentability, dated Apr. 25, 2019, 8 pp.

* cited by examiner

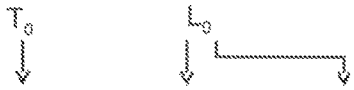

Clearances, creepage distances and separation distances

| 1 | 2 | | 3 | | 4 | | 5 | | 6 | | 7 | |
|---|---|---|---|---|---|---|---|---|---|---|---|---|
| Voltage (peak value) V | Clearance in air mm | | Separation distance through casting compound mm | | Separation distance through solid insulation mm | | Creepage distance in air mm | | Creepage distance under protective coating mm | | Comparative tracking index (CTI) | |
| Level of protection | ia, ib | ic | ia, ib | ic | ia, ib | ic | ia, ib | ic | ia, ib | ic | ia | ib, ic |
| 10 | 1.5 | 0.4 | 0.5 | 0.2 | 0.5 | 0.2 | 1.5 | 1.0 | 0.5 | 0.3 | — | |
| 30 | 2.0 | 0.8 | 0.7 | 0.2 | 0.5 | 0.2 | 2.0 | 1.3 | 0.7 | 0.3 | 100 | 100 |
| 60 | 3.0 | 0.8 | 1.0 | 0.3 | 0.5 | 0.3 | 3.0 | 1.9 | 1.0 | 0.6 | 100 | 100 |
| 90 | 4.0 | 0.8 | 1.3 | 0.3 | 0.7 | 0.3 | 4.0 | 2.1 | 1.3 | 0.6 | 100 | 100 |
| 190 | 5.0 | 1.5 | 1.7 | 0.6 | 0.8 | 0.6 | 8.0 | 2.5 | 2.6 | 1.1 | 175 | 175 |
| 375 | 6.0 | 2.5 | 2.0 | 0.6 | 1.0 | 0.6 | 10.0 | 4.0 | 3.3 | 1.7 | 175 | 175 |
| 550 | 7.0 | 4.0 | 2.4 | 0.8 | 1.2 | 0.8 | 15.0 | 6.3 | 5.0 | 2.4 | 275 | 175 |
| 750 | 8.0 | 5.0 | 2.7 | 0.9 | 1.4 | 0.9 | 18.0 | 10.0 | 6.0 | 2.9 | 275 | 175 |
| 1 000 | 10.0 | 7.0 | 3.3 | 1.1 | 1.7 | 1.1 | 25.0 | 12.5 | 8.3 | 4.0 | 275 | 175 |
| 1 300 | 14.0 | 8.0 | 4.6 | 1.7 | 2.3 | 1.7 | 36.0 | 13.0 | 12.0 | 5.8 | 275 | 175 |
| 1 575 | 16.0 | 10.0 | 5.3 | * | 2.7 | * | 49.0 | 15.0 | 16.3 | * | 275 | 175 |
| 3.3 k | * | 18.0 | 9.0 | * | 4.5 | * | * | 32.0 | * | * | * | * |
| 4.7 k | * | 22.0 | 12.0 | * | 6.0 | * | * | 50.0 | * | * | * | * |
| 9.5 k | * | 45.0 | 20.0 | * | 10.0 | * | * | 100.0 | * | * | * | * |
| 15.6 k | * | 70.0 | 33.0 | * | 16.5 | * | * | 150.0 | * | * | * | * |

FIG. 1

PLANAR TRANSFORMER HAVING INTEGRATED RING CORE

FIELD

The present invention generally relates to the field of interface technology with electronic components that can be employed for measurement, control, and/or closed-loop control tasks, in particular as an isolation amplifier. Such isolation amplifiers provide galvanic isolation between a primary circuit and a secondary circuit and are eligible for intrinsically safe operation, for example.

The present invention relates to a transformer, in particular a planar transformer not susceptible to interference and suitable for intrinsically safe electrical circuits, which will be referred to as a planar, intrinsically safe transformer below.

BACKGROUND

Intrinsically safe transformers are used for galvanic isolation of electrical circuits in compliance with several standards, and such transformers can be used to transfer both power and signals and/or data.

Various regulations and standards, for example DIN EN 60079-11, specify minimum distances for the isolation of electrical circuits and thus also of the windings or winding turns of the transformers for different safety classes of equipment and specified types of protection against ignition, so that if these minimum distances are complied with, an electrical circuit is considered to be intrinsically safe. A electrical circuit is intrinsically safe in this respect and within the scope of the invention if under the conditions specified in the standard and relating to undisturbed operation and specific fault conditions, there will neither be a spark occurring nor a thermal effect which might cause ignition of a particular explosive atmosphere. Consequently, in the case of an intrinsically safe transformer, the electrical circuits thereof are also intrinsically safe under the conditions specified in the standard.

The specified minimum distances, in turn, depend on the voltage peak value and the insulating medium, and with respect to the insulating medium they are further subdivided into minimum distances through solid insulation and through a clearance in air and creepage distances. For example, as can be seen from the table of FIG. 1, for a typical isolation class such as level of protection ia, ib at 375 V, for example, minimum distances are specified as a minimum separation distance through solid insulation of 1 mm, a minimum creepage distance in air of 10 mm, and a minimum creepage distance under a protective coating of about 3.3 mm, with ia and ib defining respective levels of protection and ia defining the highest and is the lowest level of protection. Intrinsically safe transformers are therefore designed and optimized in terms of geometry such that the required separation distances for a particular level of protection are guaranteed. This can be ensured by wound coils as well as by printed or etched coils on printed circuit boards. An advantage of printed or etched coils is that no additional winding processes are required and good reproducibility can be ensured. Further advantages may include an improved thermal performance with the same core volume. Furthermore, manufacturing costs can be lower.

DE 10 2012 003 364 A1 discloses a planar, intrinsically safe transformer with galvanically isolated electrical circuits, which comprises a layer structure and a magnetic core which at least partially surrounds the layer structure.

DE 10 2012 003 365 A1 discloses another planar, intrinsically safe transformer with galvanically isolated electrical circuits, which comprises a layer structure including a first magnetic layer and a second magnetic layer, the first and second magnetic layers defining magnetic core portions of a non-closed magnetic core.

SUMMARY

It is an object of the present invention to propose an alternative design of a planar transformer, in particular of a planar, intrinsically safe transformer, which in particular has a closed magnetic core. Another object is to propose a planar transformer, in particular a planar, intrinsically safe transformer, which features a smaller installation size compared to the prior art.

As a solution, a planar transformer is proposed, in particular an intrinsically safe transformer with the features of independent claim 1. Advantageous embodiments of the transformer according to the invention are specified in the dependent claims.

Accordingly, a planar transformer, in particular an intrinsically safe transformer is proposed, which has a vertical dimension and a horizontal dimension and which comprises a sandwich-type layer structure including a plurality of layers extending horizontally and arranged vertically on top of one another, comprising a first and a second conductive, in particular electrically conductive layer and at least one insulating inner layer disposed between the two conductive layers, and a plurality of electrical circuits, wherein a first electrical circuit and at least a second electrical circuit are galvanically isolated from each other, and at least one ring-type magnetic core (also referred to as a magnetic ring core or only as a core below) which has a hole and acts at least on the first electrical circuit and on the second electrical circuit.

Here, the core has in particular two end faces and two lateral surfaces, and the end faces are aligned substantially parallel to the horizontal extension of the layer structure.

Such a planar, in particular intrinsically safe transformer is distinguished, according to the invention, by the fact that the core is arranged within the at least one insulating inner layer, that a conductor of the first electrical circuit and a conductor of the second electrical circuit each have a winding with at least one winding turn, and that the at least one winding turn of the first electrical circuit and the at least one winding turn of the second electrical circuit each extend along the first conductive layer and along the second conductive layer and through the at least one insulating inner layer and through the hole of the core.

At least portions of the conductors of the first and the at least second electrical circuits extend in a common plane. Portions of the at least one winding turn of each of the at least two electrical circuits extend in a plane above the ring-type magnetic core, and portions thereof extend in a plane below. Thus, the winding of the first electrical circuit and the winding of the second electrical circuit are placed substantially side by side.

For a thorough understanding it should again be mentioned that a winding comprises or includes at least one winding turn, a winding turn being a single loop of a conductor around or at least substantially around the magnetic core.

The present invention offers many advantages. The transformer according to the invention, in particular in the case of an intrinsically safe transformer, is in particular suitable for use in explosion protection environments and yet has a very compact and especially flat design saving installation height, so that it can be installed in very flat housings, for example. Since the ring-type magnetic core is completely integrated into the insulating inner layer, all insulation requirements can be achieved with good reproducibility. If the planar transformer is in the form of a printed circuit board transformer, for example, the ring core will be completely integrated into the insulating material of the printed circuit board.

Since the magnetic ring core acts on the at least two electrical circuits, the transformer of the invention may also be referred to as a ring core coupler and the first and second electrical circuits may also be referred to as primary and secondary electrical circuits. Conveniently, the ring-type magnetic core may have different geometric shapes, i.e. it may not only be circular, but also oval or polygonal.

According to an advantageous embodiment of the invention, in particular if the transformer is in the form of a printed circuit board transformer, at least one first conductive track for the first electrical circuit and at least one second conductive track for the second electrical circuit are defined by each of the first conductive layer and the second conductive layer, wherein the at least one winding turn of the first electrical circuit comprises the first conductive track of the first conductive layer and the first conductive track of the second conductive layer, which are interconnected at one of their free end portions through a conductive via extending through the at least one insulating inner layer, and wherein the at least one winding turn of the second electrical circuit comprises the second conductive track of the first conductive layer and the second conductive track of the second conductive layer, which are interconnected at one of their free end portions through a conductive via extending through the at least one insulating inner layer.

Here, a free conductive track end portion is understood to mean in particular an end portion of a conductive track which is otherwise connected or bonded in a non-conductive manner. Expediently, the conductive tracks of the winding turns extend substantially radially from the hole of the magnetic ring core toward the periphery of the conductive layer. Furthermore, the conductive tracks preferably extend substantially parallel to at least one of the end faces of the ring core, and/or the vias extend substantially perpendicular to at least one of the end faces of the ring core or parallel to at least one of the lateral surfaces of the ring core. Expediently, the vias are continuously extended through the at least one insulating inner layer and are plated with a conductive material.

In another advantageous embodiment of the invention, the first electrical circuit and/or the second electrical circuit comprise a plurality of winding turns, and the plurality of winding turns of an electrical circuit are interconnected such that a conductive track of the one winding turn is connected to a conductive track of the further winding turn at one of their free conductive track end portions through a conductive via extending through the at least one insulating inner layer.

Thus, a winding may also comprise a plurality of winding turns, and a different number of turns per winding is also possible, so that the transformer can be used in particular as an isolation amplifier or as a step-down or step-up transformer. Furthermore, a winding may comprise a plurality of winding segments each comprising at least one turn, which segments may be spaced apart from each other.

According to a further embodiment of the invention it is preferably contemplated that the first electrical circuit and the at least second electrical circuit have a first isolation distance to each other, and that there is no geometric location of the transformer where the first isolation distance between the electrical circuits is less than a minimum isolation distance T0. Thus, the required separation distances through solid insulation as specified according to a respective standard for protection in explosive atmospheres can be complied with in any case, for example according to the version of the EN 60079-11 standard applicable at the priority date of the present application. FIG. 1 shows a table with clearances, creepage distances and separation distances, wherein the values given therein correspond to the table 5 of the version of the EN 60079-11 standard applicable at the priority date of the present application.

According to a further preferred embodiment of the invention it is contemplated that each of the electrical circuits has a second isolation distance to the core, and that there is no geometric location of the transformer where the second isolation distance between the electrical circuits and the core is less than the minimum isolation distance T0/2 (T0 divided by 2), i.e. than half the minimum isolation distance T0.

According to a particularly preferred embodiment of the invention it is contemplated that the first conductive layer and/or the second conductive layer is an outer layer of the sandwich-type layer structure, and that each conductor of the first electrical circuit extending along an outer conductive layer has a third isolation distance to each conductor of the at least second electrical circuit extending along the same outer conductive layer, and that there is no geometric location in the respective outer conductive layer of the transformer where the third isolation distance between the electrical circuits is less than a minimum isolation distance L0. Thus, the required distances with respect to creepage distances through air or under a protective coating as specified in compliance with a respective standard for protection in explosive atmospheres, such as EN 60079-11 (see FIG. 1), for example, can also be met.

In a further embodiment of the invention, the sandwich-type layer structure comprises at least one insulating outer layer, and the first conductive layer and/or the second conductive layer are disposed between an insulating inner layer and an insulating outer layer. Thus, the conductive layer is covered by the insulating material of the insulating inner layer and of the insulating outer layer.

According to a further embodiment of the invention it is preferably contemplated that, if a conductive layer is disposed between two insulating layers and therefore constitutes an inner conductive layer of the sandwich-type layer structure, each conductor of the first electrical circuit extending along an inner conductive layer exhibits the first isolation distance to each conductor of the at least second electrical circuit extending along the same inner conductive layer, and that there is no geometric location in the respective inner conductive layer of the transformer where the first isolation distance between the electrical circuits is less than a minimum isolation distance T0. In this case, it is in particular contemplated that the at least one insulating outer layer has a thickness corresponding to the second isolation distance, wherein the second insulation distance and therefore the thickness of the at least one insulating outer layer is not less than a minimum isolation distance T0/2 (T0 divided by 2), i.e. half the minimum isolation distance T0.

According to one embodiment of the invention it is contemplated that the at least one insulating inner layer has an ring-type recess in which the ring-type magnetic core is embedded. Thus, the magnetic ring core is surrounded by the insulating material of the insulating inner layer, in particular completely surrounded, and is isolated from the electrical circuits.

According to a further embodiment of the invention, at least two insulating inner layers are arranged on top of one another and joined to each other, in particular pressed together. Expediently in this case, the vias are extended continuously through all joined insulating inner layers and are plated with a conductive material.

Furthermore, an additional conductive layer may be disposed between two insulating inner layers.

These and further features and advantages of the present invention will become apparent from the exemplary embodiments which will be discussed in more detail below with reference to the accompanying drawings, wherein:

BRIEF DESCRIPTION OF THE DRAWINGS

FIG. 1 is a table with clearances and creepage distances and separation distances with respect to specific levels of protection, the values contained therein corresponding to Table 5 of the standard EN 60079-11 as applicable at the priority date of the present application;

DETAILED DESCRIPTION

Figure 2:
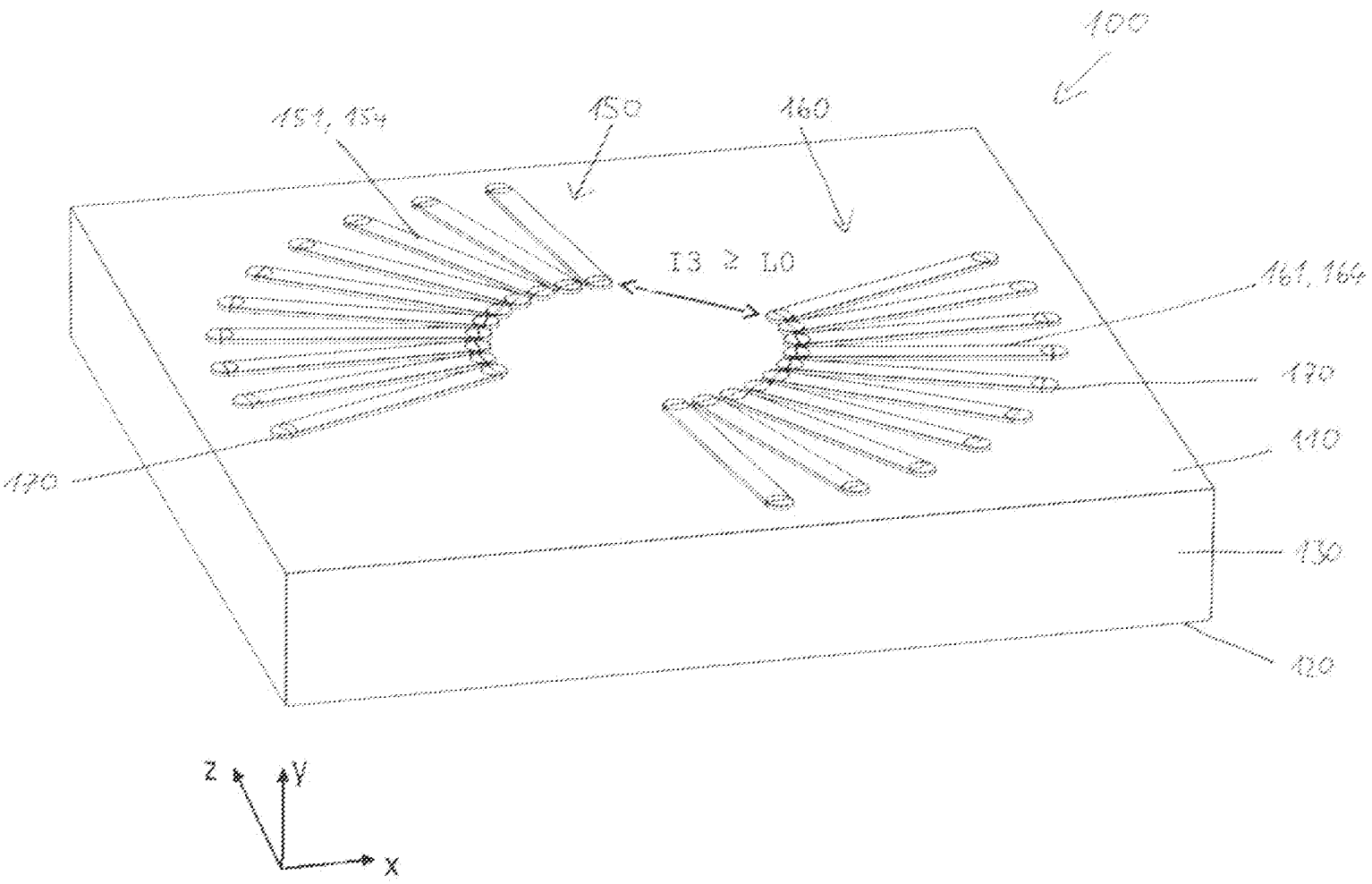
FIG. 2 is a schematic perspective view of a transformer comprising two electrical circuits according to a first exemplary embodiment of the invention.

The accompanying FIGS. 2 to 14 show, by way of example, different views based on three preferred exemplary embodiments of planar, in particular intrinsically safe, transformers 100 according to the invention, which have a vertical dimension and a horizontal dimension. In the figures, the vertical dimension extends along the Y-axis, and the horizontal dimension extends along the X- and Z-axes of the coordinate system as indicated in each of FIGS. 2, 4, and 11 for the sake of clarity.

The transformers 100 accordingly have a sandwich-type layer structure including a plurality of layers extending horizontally and arranged vertically on top of one another, comprising a first conductive layer 110 and a second conductive layer 120 and at least one insulating inner layer 130 disposed between the two conductive layers. Furthermore, the transformers each comprise a plurality of electrical circuits, wherein a first electrical circuit 150 and at least a second electrical circuit 160 are galvanically isolated from each other, and at least one ring-type magnetic core 140 having a hole 145, which core acts at least on the first electrical circuit 150 and on the second electrical circuit 160. The core 140 is disposed within the at least one insulating inner layer 130 in each case, and a conductor 151 of the first electrical circuit 150 and a conductor 161 of the second electrical circuit 160, i.e. a conductor provided for the current flow in the respective electrical circuit, has a respective winding 152 or 162, respectively, each comprising at least one winding turn 153 or 163, respectively. The at least one winding turn 153 of the first electrical circuit 150 and the at least one winding turn 163 of the second electrical circuit 160 each extends on the first conductive layer 110 and on the second conductive layer 120 and through the at least one insulating inner layer 130 and through the hole 145 of the core 140.

A first exemplary embodiment with possible refinements is shown in FIGS. 2, 3, 6, 8, 9, and 10. A second exemplary embodiment with possible refinements is shown in FIGS. 4, 5, 6, and 7. A third exemplary embodiment with possible refinements is shown in FIGS. 6, 11, 12, 13, and 14.

FIG. 1 shows a table specifying minimum distances with respect to minimum clearances and creepage distances and separation distances through solid insulation for specific levels of protection for ensuring intrinsically safe electrical circuits and hence also intrinsically safe transformers with respect to the electrical circuits thereof, and the values specified therein correspond to Table 5 of the standard EN 60079-11 applicable at the priority date of the present application, as an exemplary standard for protection in explosive atmospheres. From this table, particular minimum distances are apparent, which are therefore specified by the cited standard. These minimum distances, which will also be referred to as minimum isolation distances T0 and L0 below and in the claims, are dependent on the insulating medium, so that the minimum distances to be observed are subdivided based on solid insulation, clearance in air or creepage distances. As can be seen from the table, in a typical insulation class such as level of protection ia, ib at a voltage peak value of 375 V, hereinafter also referred to as level of protection 375 V ia, ib, the minimum separation distance for solid insulation to be observed as a minimum distance or minimum isolation distance T0 is 1 mm, for example, and the minimum creepage distance to be observed as a minimum distance or minimum isolation distance L0 is 10 mm in air and about 3.3 mm under a protective coating. Thus, for the level of protection 375 V ia, ib, a minimum separation distance corresponding to the minimum isolation distance of T0=1.0 mm has to be met within a printed circuit board, while a minimum isolation distance of L0=10.0 mm or 3.3 mm corresponding to the creepage distances in air and under a protective coating, respectively, has to be met on the outer layer of the printed circuit board.

For the following description, three isolation distances are defined. Insulation distance I1 corresponds to a minimum isolation distance T0 at least required according to a required level of protection, isolation distance I2 is at least T0/2, and isolation distance I3 corresponds to a minimum isolation distance L0 at least required according to a required level of protection.

As mentioned above, FIG. 2 refers to the first exemplary embodiment of a planar, intrinsically safe transformer according to the invention, which is in the form of a printed circuit board transformer here and comprises two separate electrical circuits 150 and 160, each one comprising a respective winding 152 and 162, respectively, each one with a plurality of winding turns 153 and 163 in the present example. What can be seen here of the windings are respective conductive tracks 154 of the conductor 151 of the first electrical circuit 150 and respective conductive tracks 164 of the conductor 161 of the second electrical circuit 160 along the first conductive layer 110 which is an outer layer of the printed circuit board. Here, the conductive patterns of the first electrical circuit 150 and of the second electrical circuit 160 are separated from each other in the conductive layers 110 and 120 by the third isolation distance I3, wherein I3 is equal to or greater than the specified minimum isolation distance L0. Also, the connection points between the conductive tracks 154, 164 and the conductive vias 155, 165 are clearly visible.

Figure 3:
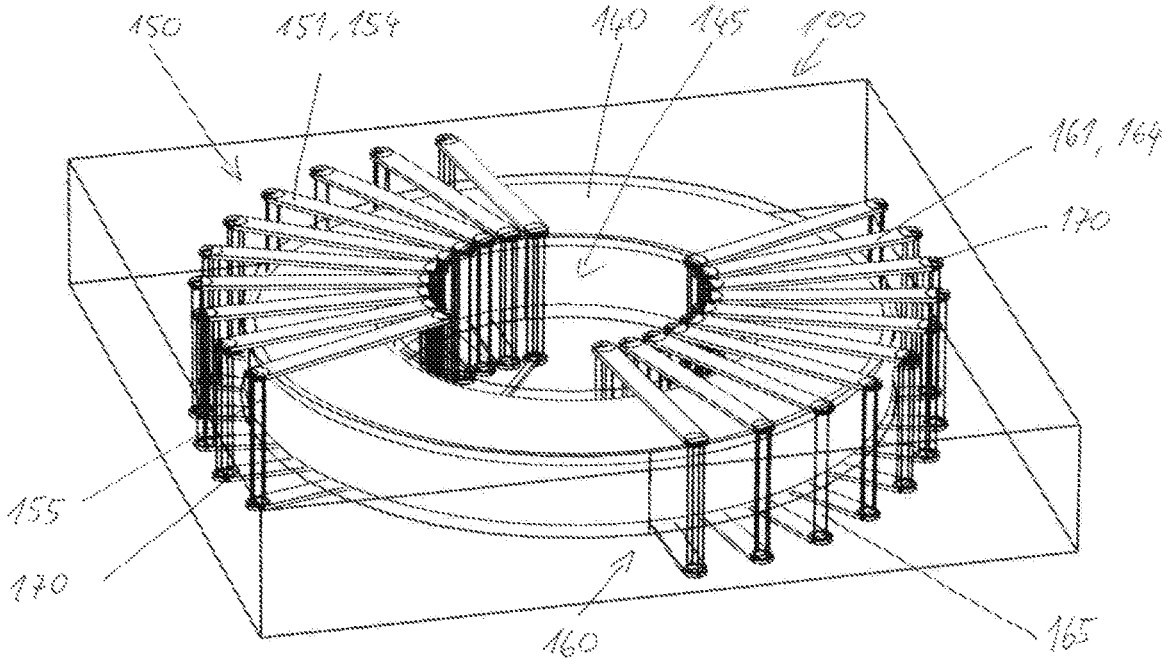
FIG. 3 is a further schematic perspective view of the transformer according to the first embodiment.

FIG. 3 shows a possible embodiment of such a transformer based on the transformer 100 of FIG. 2, with the insulating material illustrated transparently, so that now the integrated ring-type magnetic core 140, its hole 145, and the conductive tracks 154, 164 on the second conductive layer 120 which is also an outer layer of the printed circuit board can also be seen very well. Also visible are the vias 155, 165 of the first and second electrical circuits 150, 160. The winding turns 153, 163 of windings 152, 162 of the first and second electrical circuits 150, 160 are defined by conductive tracks 154, 164 on the outer layers and by vias 155, 165 and enclose a closed magnetic core 140 which is integrated into the printed circuit board.

Figure 6:
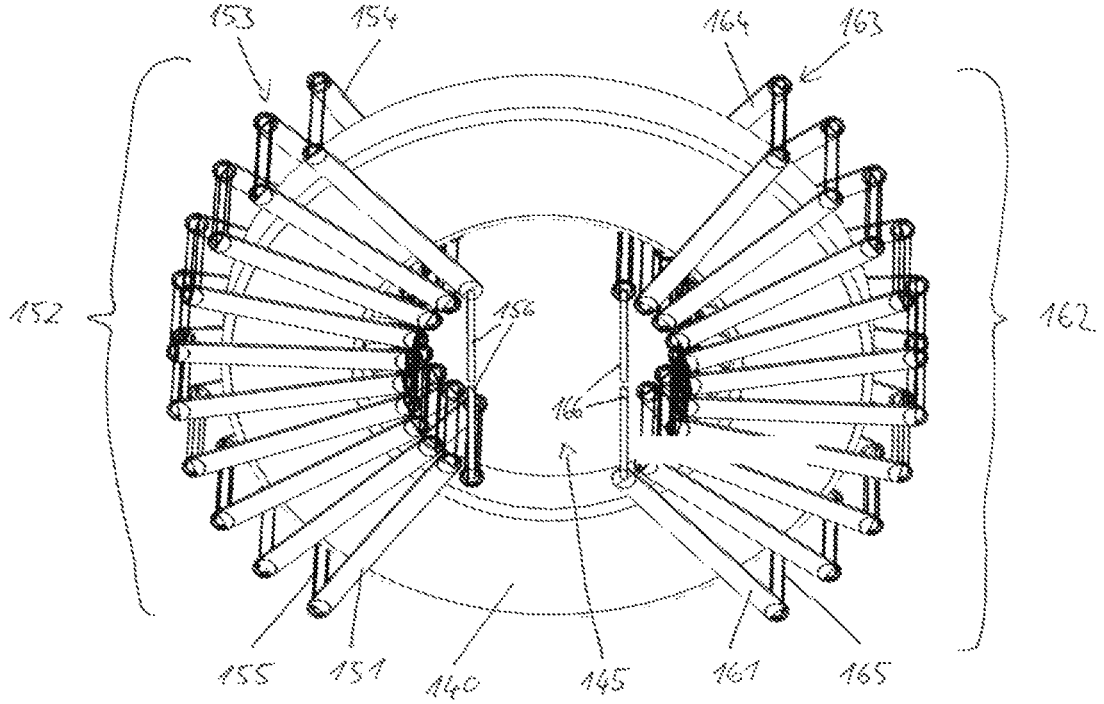
FIG. 6 is a schematic perspective view of the magnetic ring core and the windings of the two electrical circuits of the transformer according to the first or second or a third exemplary embodiment.

FIG. 6 shows a possible embodiment of such a transformer based on the transformer 100 of FIG. 2, with the magnetic ring core, in particular that of FIG. 3, without insulation material and from a different perspective. Again, the windings 152, 162 of the two electrical circuits 150, 160 of the transformer 100 can be seen here. Also, terminals 156 and 166 for the external wiring (not shown) of the transformer 100 can be seen here. The components shown in FIG. 6 may also form part of the transformer according to the second or third embodiment, in the same or a very similar design and arrangement.

Figure 8:
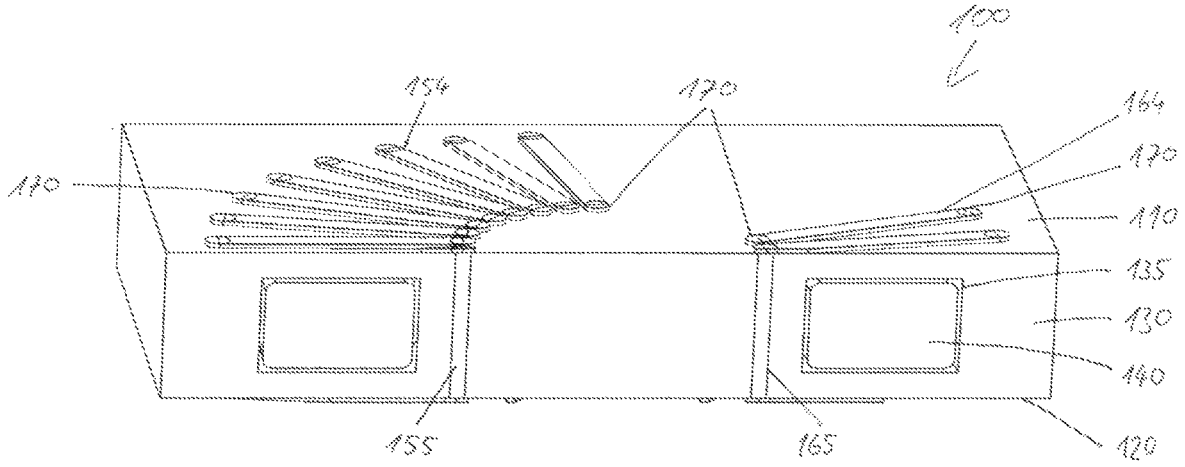
FIG. 8 is a schematic perspective sectional view of the transformer according to the first exemplary embodiment.
Figure 9:
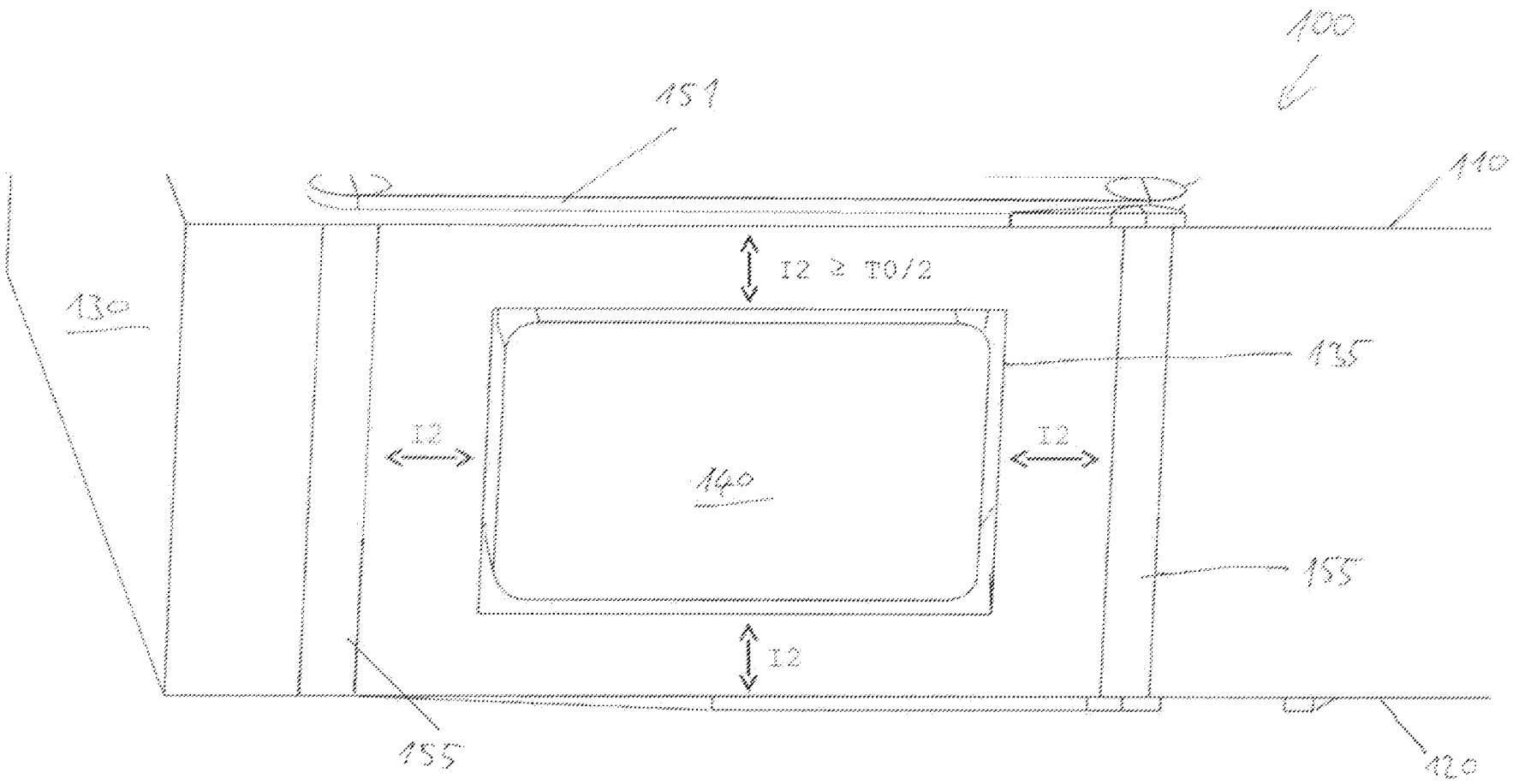
FIG. 9 is a further schematic perspective sectional view of the transformer according to the first exemplary embodiment.
Figure 10:
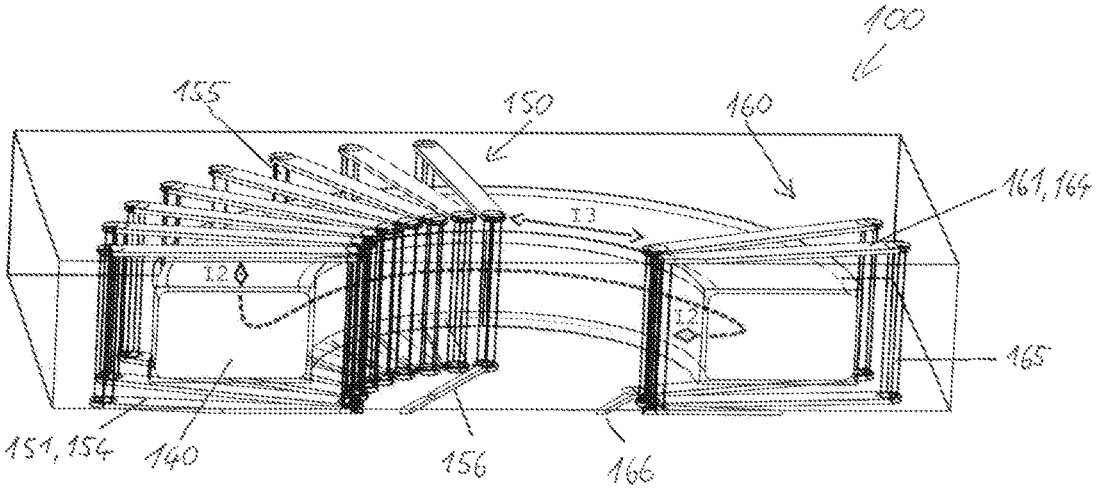
FIG. 10 is a further schematic perspective sectional view of the transformer according to the first exemplary embodiment.

FIGS. 8, 9, and 10 show sectional views of possible embodiments of the transformer based on the transformer 100 of FIG. 2. As can be seen here, an inner insulating layer 130 extends around the magnetic core 140 enclosing it in all spatial directions, and the thickness of this layer guarantees a second isolation distance I2 between the core and all other electrically conductive structures of the electrical circuits 150 and 160, which is equal to or greater than half the minimum isolation distance T0. The magnetic core is considered to be electrically conductive and thus to be an equipotential surface in terms of isolation. In order to obtain the minimum isolation distance of T0 for solid insulation corresponding to the minimum separation distance required by a standard, it is composed of two second isolation distances I2 as follows: An isolation distance which is at least equal to half the minimum isolation distance T0 is met everywhere between the first winding 152 and the magnetic core 140. Also, at least an isolation distance equal to half the minimum isolation distance T0 is met between the magnetic core and all other windings (e.g. second winding 162). This gives a combined isolation distance of T0/2+T0/2=T0 as required by the EN 60079-11 standard applicable at the priority date of the present application. It is important that the respective applicable standard allows for proportionate combination of isolation distances, which is often the case.

The required minimum isolation distances T0 and L0 can be easily understood and verified by way of so-called minimum insulation paths between the electrical circuits 150, 160 that are isolated from each other, such as shown in FIG. 10, for example.

Accordingly, a first insulation path extends from the winding 152 of the first electrical circuit 150 on the left side of the transformer 100 directly over the surface of the first conductive layer 110 to the winding 162 of the second electrical circuit 160 on the right side of the transformer. The first insulation path extends similarly also over the surface of the second conductive layer 120 (not shown). If the respective conductive layer 110 or 120 is an outer layer of the transformer 100, the shortest distance between the separated electrical circuits 150 and 160 must be equal to the third isolation distance I3, which in turn must be equal to or greater than the specified minimum isolation distance L0. For the level of protection 375 V ia, ib, for example, this shortest distance has to be at least 3.3 mm, if the respective conductive layer 110 or 120 as the outer layer of the transformer 100 is an outer layer of the printed circuit board but is coated with a special lacquer. If this lacquer coating is not provided, the shortest distance must be 10 mm instead of 3.3 mm, for example (see FIG. 1). However, a solder resist as commonly used in printed circuit board technology cannot be regarded as a protective coating in the sense of a standard and can therefore not reduce the isolation distances, for example from 10 mm to 3.3 mm. Therefore, the solder resist will not be discussed further below, although it may be employed in the exemplary embodiments. Therefore, if an outer conductive layer of the layer structure is mentioned below, this does not exclude that the conductor of the outer layer is additionally covered by a protective lacquer.

A second insulation path first extends from the winding 152 of the first electrical circuit 150 on the left side of the transformer 100 through the solid insulation material of the transformer or the printed circuit board thereof to the magnetic core 140. From there, the second insulation path extends through the magnetic core (shown as a dashed line) and is not counted, and from there again through the solid insulation material to arrive at the winding 162 of the second electrical circuit 160 on the right side of the transformer 100. Both the shortest distance from the first winding 152 to the magnetic core 140 and from the magnetic core 140 to the second winding 162 must be equal to the second isolation distance I2, which is equal to half the minimum isolation distance T0. Since the minimum isolation distance T0 corresponding to the minimum separation distance for solid insulation can be combined proportionally, the required minimum insulation T0 between the two windings is resulting from 2*I2=I1, or 2*T0/2=T0, and the transformer is therefore dimensioned in compliance with the standard. The length of the second insulation path passing through the magnetic core (shown as a dashed line), is not counted here, since the magnetic core cannot be considered to be an insulating material.

Figure 4:
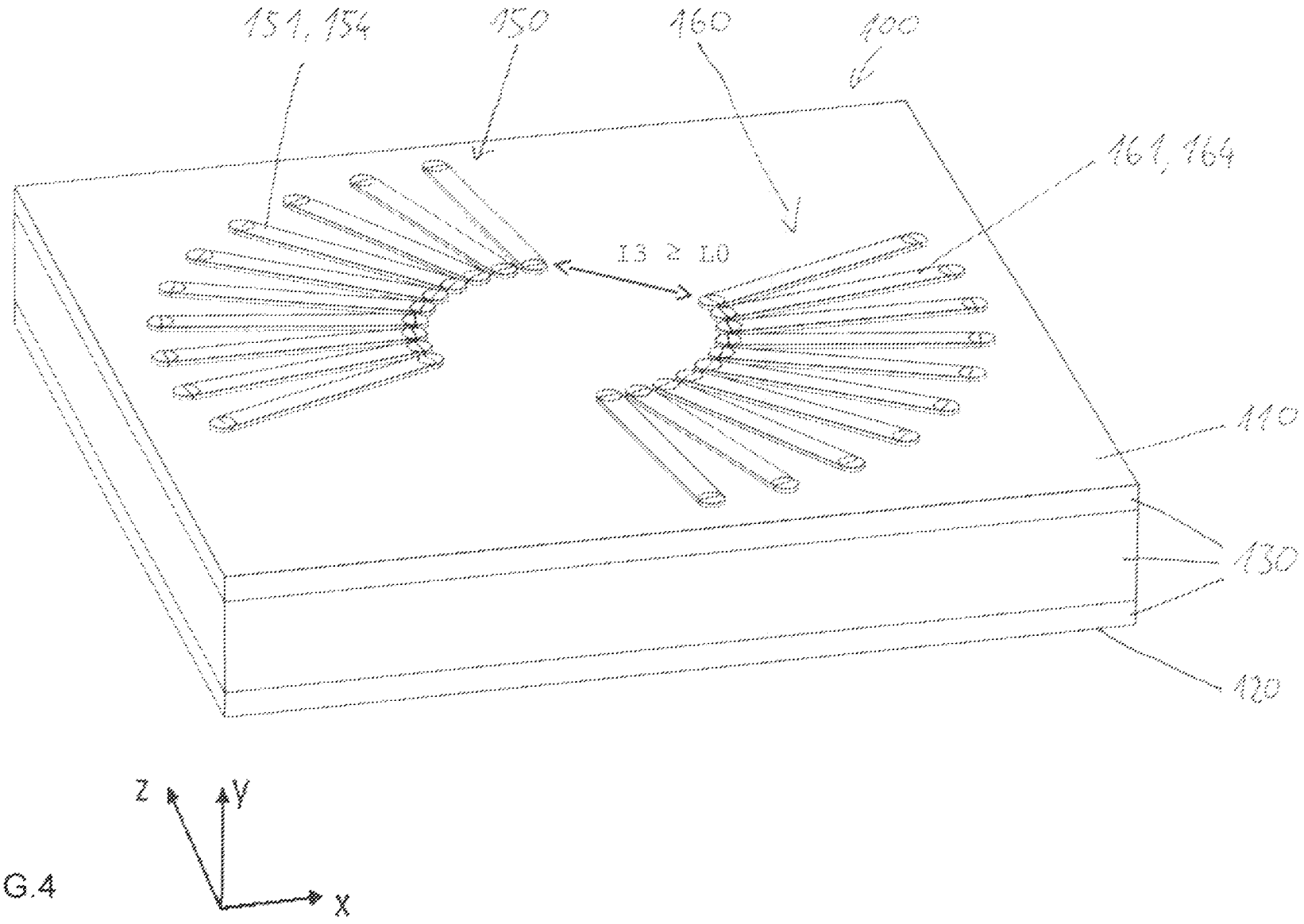
FIG. 4 is a schematic perspective view of a transformer comprising two electrical circuits according to a second exemplary embodiment of the invention.

FIG. 4 refers to the second exemplary embodiment of a planar, intrinsically safe transformer 100 according to the invention, which suitably is again in the form of a printed circuit board transformer here and comprises two separate electrical circuits 150 and 160, each one comprising a respective winding 152 and 162, each one with a plurality of winding turns 153 and 163, respectively. In contrast to the first exemplary embodiment, the transformer shown here is constructed of a plurality of insulating inner layers 130 which are interconnected, for example by being pressed together.

Figure 5:
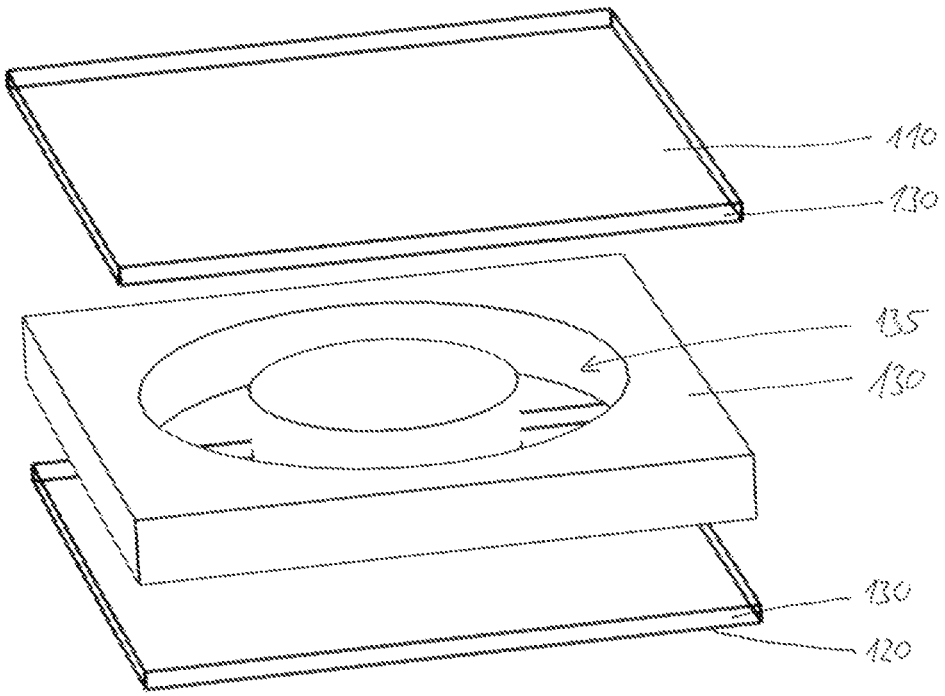
FIG. 5 is a schematic perspective exploded view illustrating the layers of the transformer according to the second exemplary embodiment.

FIG. 5 is an exploded view of a possible embodiment based on the transformer 100 of FIG. 4, showing only the insulating layers 130 thereof, so that the three individual insulating layers 130 can be clearly seen. Here, the middle one of the three insulating layers has a recess 135 for accommodating a magnetic ring core, in which the magnetic core can be embedded (see also FIG. 6, for example).

Figure 7:
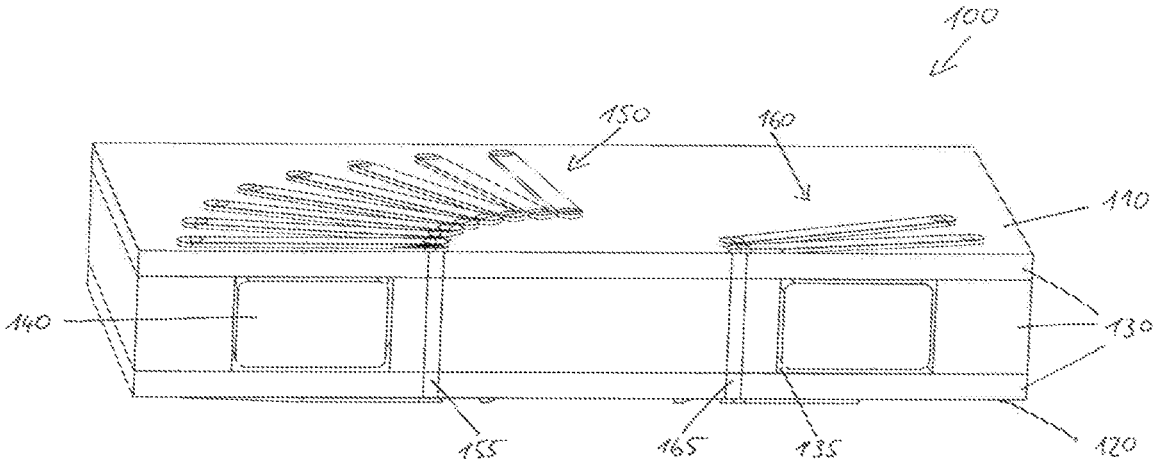
FIG. 7 is a schematic perspective sectional view of the transformer according to the second exemplary embodiment.

FIG. 7 shows a sectional view of the transformer in a possible embodiment based on the transformer 100 of FIG. 4. The magnetic core 140 consisting of ferrite material, for example, is embedded in a recess 135 of the middle insulating layer 130, and the recess 135 may be a cavity. Alternatively, the insulating material may also directly adjoin the magnetic core. Anyhow, the three inner insulating layers are joined to one another, in particular pressed together, so that a solid insulation material is resulting, so that a solid insulation is provided around the magnetic core 140 in all spatial directions with a thickness that guarantees a second isolation distance I2 between the core and all other electrically conductive structures of the electrical circuits 150 and 160, which is equal to or greater than half the minimum isolation distance T0.

Figure 11:
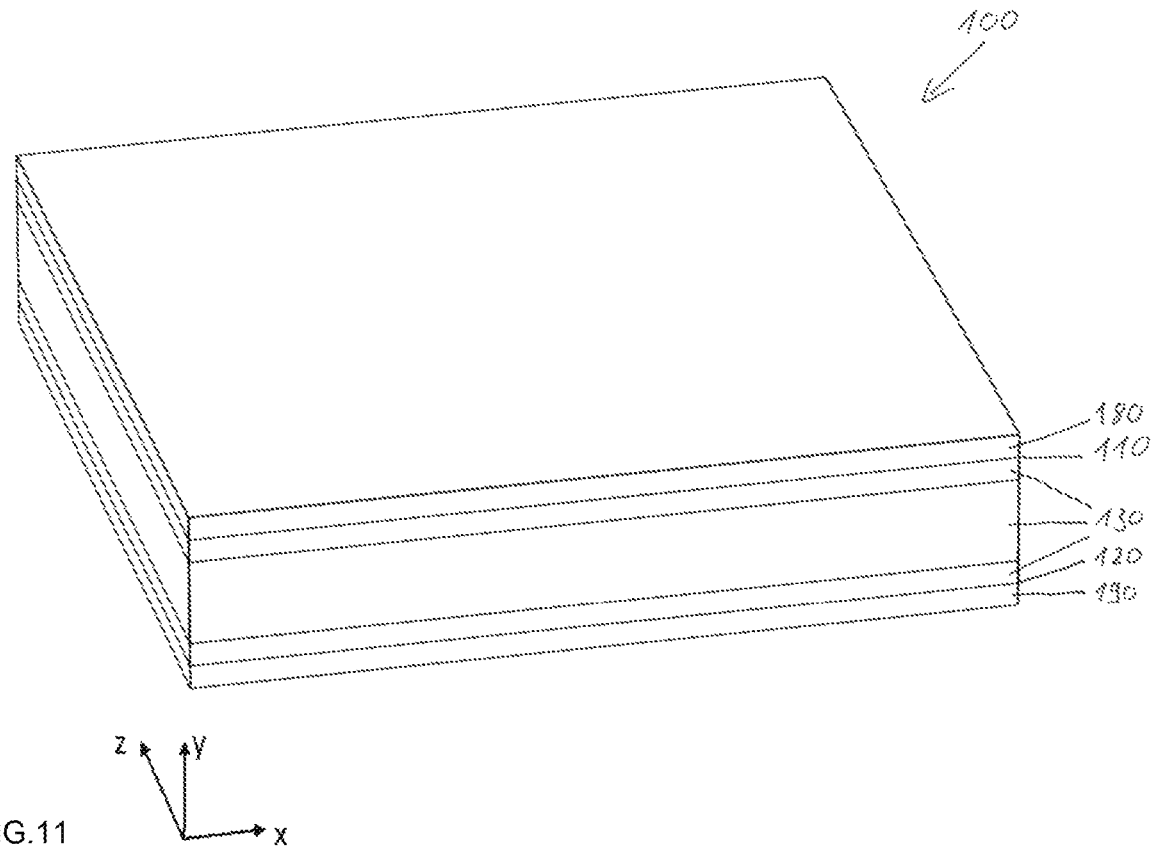
FIG. 11 is a schematic perspective view of a transformer comprising two electrical circuits according to a third exemplary embodiment of the invention.

FIG. 11 refers to the third exemplary embodiment of a planar, intrinsically safe transformer 100 according to the invention, which again is suitably provided in the form of a printed circuit board transformer here and comprises two separate electrical circuits 150 and 160, each one comprising a respective winding 152 and 162, each one with a plurality of winding turns 153 and 163, respectively. In contrast to the first and second exemplary embodiments, the transformer shown here is completely integrated, which means that in addition to an insulating inner layer 130 or a plurality of insulating inner layers 130, two insulating outer layers 180 and 190 are additionally provided. In this case, the first conductive layer 110 is disposed between the insulating inner layer 130 and the insulating outer layer 180. Furthermore, the second conductive layer 120 is disposed between the insulating inner layer 130 and the insulating outer layer 190. Thus, the conductive layers 110 and 120 are covered by the insulating material of the insulating outer layers 180 and 190, respectively.

Figure 12:
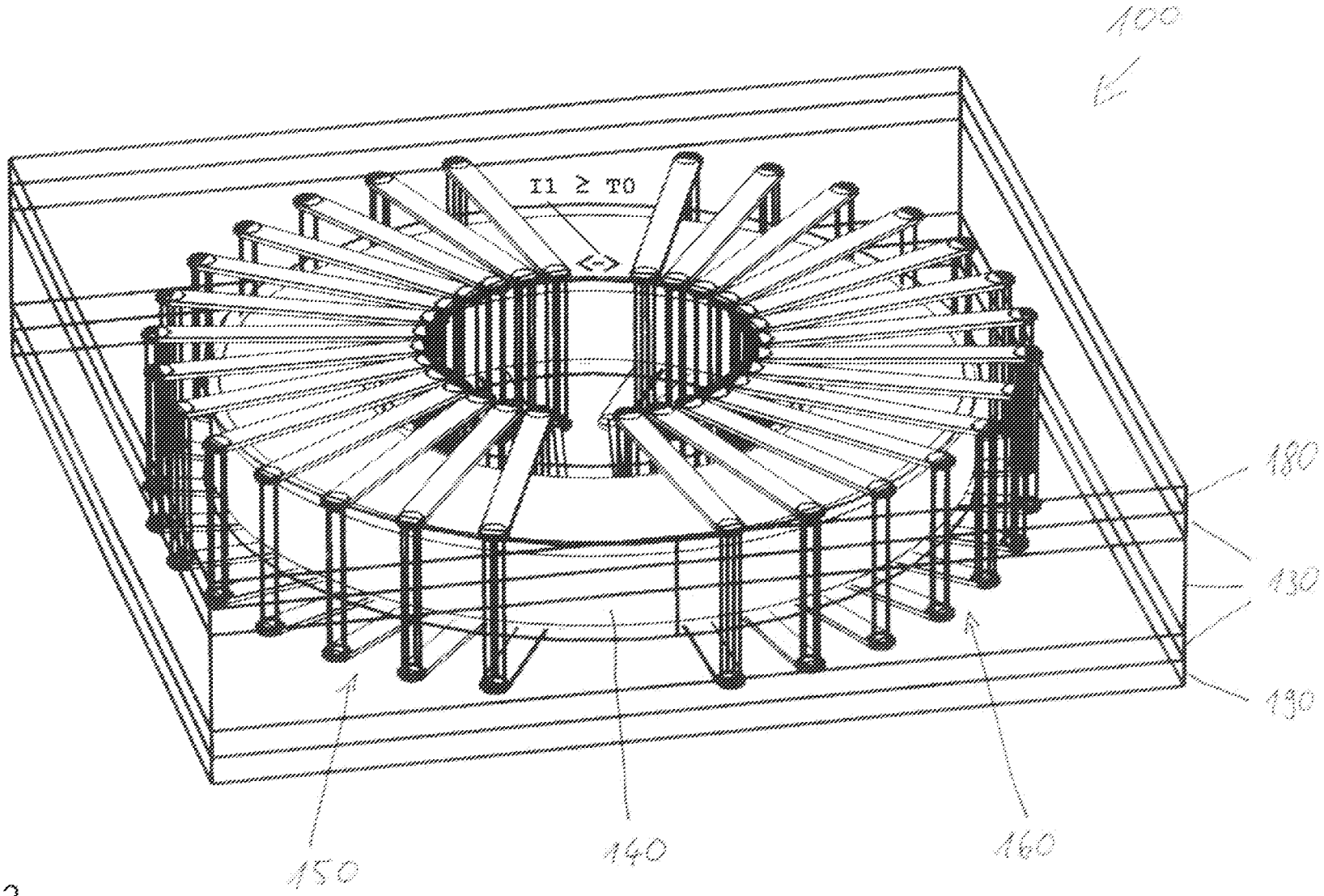
FIG. 12 is a further schematic perspective view of a transformer comprising two electrical circuits according to the third exemplary embodiment of the invention.

FIG. 12 shows a possible embodiment based on the transformer 100 of FIG. 11, with the insulating material being shown transparently so that now the integrated ring-type magnetic core 140, its hole 145, and the conductive tracks 154, 164 of the first and second electrical circuits 150, 160 can also be see very well. Also visible are the vias 155, 165 of the first and second electrical circuits 150, 160. The winding turns 153, 163 of windings 152, 162 of the first and second electrical circuits 150, 160 are defined by conductive tracks 154, 164 along the conductive layers 110 and 120 and by vias 155, 165 and enclose a closed magnetic core 140.

Since the conductive patterns of the first and second electrical circuits 150, 160 along the conductive layers 110 and 120 are now located within solid insulation material, they do no longer have to meet the third isolation distance I3 corresponding to the minimum isolation distance L0, but only the first isolation distance I1 corresponding to the small minimum isolation distance T0. As a result, the transformer can be made even more compact in its horizontal dimension compared to the first and second exemplary embodiments, however at the expense of its vertical dimension which will be increased by the thickness of the additional insulating outer layers 180, 190. Alternatively, with the same horizontal dimension the transformer may accommodate more windings or winding segments and/or more winding turns compared to the first and second exemplary embodiments, while still ensuring the required minimum isolation distances.

Figure 13:
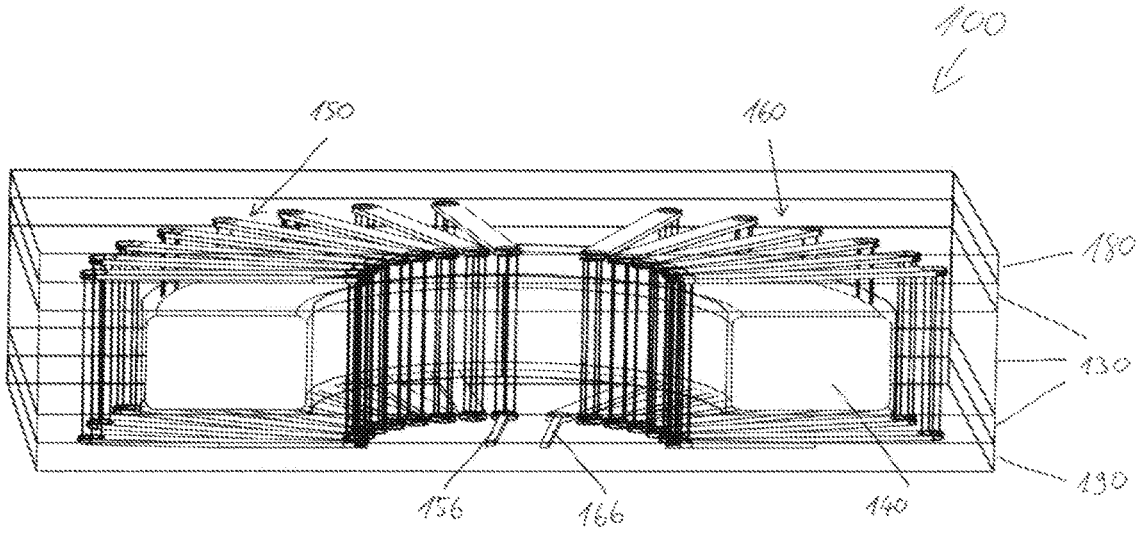
FIG. 13 is a schematic perspective sectional view of the transformer according to the third exemplary embodiment.
Figure 14:
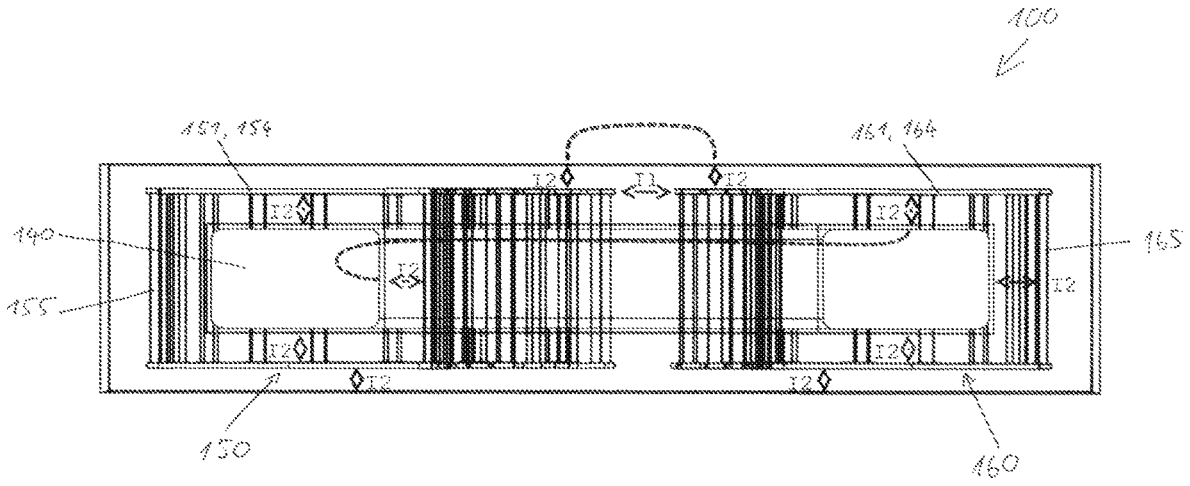
FIG. 14 is a further schematic perspective sectional view of the transformer according to the third exemplary embodiment.

FIGS. 13 and 14 show sectional views of possible embodiments of the transformer based on the transformer 100 of FIG. 11. Clearly visible in FIG. 13 are the terminals 156 and 166 for the external wiring (not shown) of the transformer 100. In particular in FIG. 14 it can further be seen that an insulation is provided around the magnetic core 140 surrounding it in all spatial directions, which has a thickness that guarantees a second isolation distance I2 between the core and all other electrically conductive structures of the electrical circuits 150 and 160, which is equal to or greater than half the minimum isolation distance T0, and that the insulation surrounding the core 140 is composed of a plurality of interconnected insulating inner layers 130. Furthermore, it can be seen in FIG. 14 that the insulating outer layers 180 and 190 have a thickness corresponding to the second isolation distance I2.

The fact that the conductive structures of the first and second electrical circuits 150, 160 along the conductive layers 110 and 120 only need to meet the first isolation distance I1 corresponding to the minimum isolation distance T0 between one another, can easily be understood and verified by way of the minimum insulation paths between the electrical circuits 150, 160 insulated from one another, shown in FIG. 14. In contrast to the first exemplary embodiment and to FIG. 10, the first insulation path according to FIG. 14 extends from the winding 152 of the first electrical circuit 150 on the left side of the transformer 100 through the solid insulating material of the insulating outer layer. From there, the first insulation path extends over the surface of the insulating outer layer (shown as a dashed line) and from there again through the solid insulating material to the winding 162 of the second electrical circuit 160 on the right side of the transformer 100. The first insulation path extends similarly also over the surface of the insulating outer layer 190 (not illustrated).

Since the minimum isolation distance T0 corresponding to the minimum separation distance for solid insulation can be combined proportionally, the required minimum insulation T0 between the two windings is resulting from 2*I2=I1, or 2*T0/2=T0, and the transformer is therefore dimensioned in compliance with the standard. The length of the first insulation path passing over the surface of the insulating outer layer (shown as a dashed line) is not counted here.

Generally, at least the isolation distance T0 must result in total for each possible insulation path.

LIST OF REFERENCE NUMERALS

100 Planar, in particular intrinsically safe transformer
110 First conductive layer
120 Second conductive layer
130 Insulating inner layer
135 Ring-type recess
140 Ring-type magnetic core

145 Hole of magnetic core
150 First electrical circuit
151 Conductor of first electrical circuit
152 Winding of first electrical circuit
153 Winding turn of first electrical circuit
154 Conductive track for first electrical circuit
155 Conductive via for first electrical circuit
156 Terminals for external wiring
160 Second electrical circuit
161 Conductor of second electrical circuit
162 Winding of second electrical circuit
163 Winding turn of second electrical circuit
164 Conductive track for second electrical circuit
165 Conductive via for second electrical circuit
166 Terminals for external wiring
170 Free end portion of a conductive track
180 Insulating outer layer
190 Insulating outer layer
I1 First isolation distance
I2 Second isolation distance
I3 Third isolation distance

The invention claimed is:

1. A planar, intrinsically safe transformer having a vertical dimension and a horizontal dimension, comprising:

a sandwich-type layer structure including a plurality of layers extending horizontally and arranged vertically on top of one another, comprising a first and a second conductive layer and at least one insulating inner layer disposed between the two conductive layers;

a plurality of electrical circuits, wherein a first electrical circuit and at least a second electrical circuit are galvanically isolated from each other; and at least one ring-type magnetic core having a hole, which acts at least on the first electrical circuit and on the second electrical circuit, wherein the core is arranged within the at least one insulating inner layer;

a conductor of the first electrical circuit and a conductor of the second electrical circuit each have a winding with at least one winding turn, wherein the at least one winding turn of the first electrical circuit and the at least one winding turn of the second electrical circuit each extends along the first conductive layer and along the second conductive layer and through the at least one insulating inner layer and through the hole of the core; and an insulation provided around the magnetic core enclosing the magnetic core in all spatial directions, wherein the insulation is formed by the insulating inner layer and has a thickness, which guarantees a second isolation distance between the core and all other electrically conductive structures of the electric circuits and which is equal to or greater than half a first minimum isolation distance, wherein the first minimum isolation distance is defined as a minimum separation distance between the first electrical circuit and the second electrical circuit.

2. The transformer as claimed in claim 1, wherein:

at least one first conductive track for the first electrical circuit and at least one second conductive track for the second electrical circuit are defined by each of the first conductive layer and the second conductive layer; and the at least one winding turn of the first electrical circuit comprises the first conductive track of the first conductive layer and the first conductive track of the second conductive layer, which are interconnected at one of their free end portions through a conductive via extending through the at least one insulating inner layer; and the at least one winding turn of the second electrical circuit comprises the second conductive track of the first conductive layer and the second conductive track of the second conductive layer, which are interconnected at one of their free end portions through a conductive via extending through the at least one insulating inner layer.

3. The transformer as claimed in claim 1, wherein at least one of the first electrical circuit and the second electrical circuit comprises a plurality of winding turns, and wherein the plurality of winding turns of an electrical circuit are interconnected such that a conductive track of the one winding turn is connected to a conductive track of the further winding turn at one of their free conductive track end portions through a conductive via extending through the at least one insulating inner layer.

4. The transformer as claimed in claim 3, wherein the first electrical circuit and the at least second electrical circuit have a first isolation distance to each other, and wherein the first isolation distance between the electrical circuits at least corresponds to the first minimum isolation distance at any geometric location of the transformer.

5. The transformer as claimed in claim 1, wherein at least one of the first conductive layer and the second conductive layer is an outer layer of the sandwich-type layer structure; and wherein each conductor of the first electrical circuit extending along an outer conductive layer has a third isolation distance to each conductor of the at least second electrical circuit extending along the same outer conductive layer; and wherein the third isolation distance between the electrical circuits corresponds at least to a second minimum isolation distance at any geometric location of the respective outer conductive layer of the transformer.

6. The transformer as claimed in claim 1, wherein the sandwich-type layer structure comprises at least one insulating outer layer; and wherein at least one of the first conductive layer and the second conductive layer are disposed between an insulating inner layer and an insulating outer layer.

7. The transformer as claimed in claim 6, further comprising a conductive layer disposed between two insulating layers so that the conductive layer comprises an inner conductive layer of the sandwich-type layer structure, each conductor of the first electrical circuit extending along an inner conductive layer has a first isolation distance to each conductor of the at least second electrical circuit extending along the same inner conductive layer; and wherein the first isolation distance between the electrical circuits corresponds at least to the first minimum isolation distance at any geometric location of the respective inner conductive layer of the transformer.

8. The transformer as claimed in claim 1, wherein the at least one insulating inner layer has a ring-type recess in which the ring-type magnetic core is embedded.

9. The transformer as claimed in claim 1, wherein at least two insulating inner layers are arranged on top of one another and joined to each other, in particular pressed together.

* * * * *